United States Patent [19]

Noyori et al.

[11] 4,399,676

[45] Aug. 23, 1983

[54] MANDREL CLEANING DEVICE FOR EXTRUSION PRESS

[75] Inventors: Tatsuhiko Noyori; Masakazu Ueda, both of Kobe; Masanobu Aoki; Takashi Kajima, both of Shimonoseki; Tsuneharu Masuda, Kobe, all of Japan

[73] Assignee: Kabushiki Kaisha Kobe Seiko Sho, Kobe, Japan

[21] Appl. No.: 267,243

[22] Filed: May 26, 1981

[30] Foreign Application Priority Data

May 24, 1980 [JP] Japan ..... 55-70445
May 24, 1980 [JP] Japan ..... 55-72792

[51] Int. Cl.[3] ..... B21C 35/06; B21C 25/04

[52] U.S. Cl. ..... 72/40; 72/253.1; 72/265; 72/273.5

[58] Field of Search ..... 72/253.1, 263, 266, 72/265, 273, 273.5, 39, 40, 370

[56] References Cited

U.S. PATENT DOCUMENTS

| | | | |
|---|---|---|---|
| 1,084,881 | 1/1914 | Gahlen | 72/263 |
| 2,988,211 | 6/1961 | Kent et al. | 72/265 |
| 3,260,095 | 7/1966 | Flanagan | 72/368 |
| 3,875,781 | 4/1975 | Zilges et al. | 72/263 |
| 3,919,870 | 11/1975 | Wassen et al. | 72/253.1 |
| 4,316,378 | 2/1982 | Ballasio et al. | 72/254 |

FOREIGN PATENT DOCUMENTS

| | | | |
|---|---|---|---|
| 18164 | 10/1908 | Norway | 72/265 |
| 629007 | 9/1949 | United Kingdom | 72/344 |
| 1019081 | 2/1966 | United Kingdom | 72/39 |
| 1335820 | 10/1973 | United Kingdom | 72/266 |
| 218583 | 5/1968 | U.S.S.R. | 72/40 |

*Primary Examiner*—Lowell A. Larson
*Attorney, Agent, or Firm*—Oblon, Fisher, Spivak, McClelland & Maier

[57] ABSTRACT

A mandrel cleaning device capable of automatically performing cleaning operation in an extrusion press of the type which has a pressurizing stem for pressing a billet in a container toward a die and a mandrel axially slidable in and relative to the pressurizing stem for determining the internal shape of a hollow extruding material, the mandrel cleaning device having a rotary mechanism for rotating the mandrel about its axis, a grinder mechanism adapted to grind a tip portion at the fore end of the mandrel, and a transfer mechanism for moving the grinder mechanism toward and away from the mandrel.

3 Claims, 9 Drawing Figures

MANDREL CLEANING DEVICE FOR EXTRUSION PRESS

BACKGROUND OF THE INVENTION

1. Field of the Invention

This invention relates to a device for cleaning a mandrel of an extrusion press.

2. Description of the Prior Art

The extrusion press which is resorted to for metal extrusion generally includes a container for holding a billet, a pressurizing stem for pressing the billet in the container toward a die, and a mandrel fitted in the pressurizing stem axially slidably relative to the latter to thereby restrict the internal shape of a hollow metal structure which is extruded through the die. In an extrusion press of this sort, cleaning of the mandrel every several or more pushes is required in order to remove metal shells which deposit on the mandrel in considerable amounts. Automation has been achieved with respect to those component parts of the press which are required in the sequential phases of each cycle of extruding operation, namely, which are required for the feed of a billet, piercing, extrusion, shearing, discard dummy block handling and the like, in contrast to the mandrel cleaning operation which still depends on manual labor. The manual cleaning operation which not only imposes a great burden on the operator but requires him to step into the press is problematic from the standpoint of safety of operation. In this connection, the conventional practice has been to use a jig with a split flange which is adapted to grip the mandrel in its flange portion and scrape off the shells utilizing the movement of the mandrel itself. However, a problem is encountered with the conventional device in that the flange portion is often pushed apart depending upon the shell condition, failing to remove completely the shells which might seriously affect the quality of the extruded products.

SUMMARY OF THE INVENTION

With the foregoing in view, the present invention has as its object the provision of a mandrel cleaning device for extrusion press, which can perform the cleaning operation automatically without depending on manual efforts and which is uniform in performance quality.

According to one feature of the present invention, there is provided a mandrel cleaning device for extrusion presses of the type which has a pressurizing stem for a pressing a billet in a container toward a die and a mandrel axially slidable in and relative to the pressurizing stem for determining the internal shape of a hollow extruding material, the mandrel cleaning device essentially including a rotary mechanism for rotating the mandrel about its axis, a grinder mechanism adapted to grind a tip portion at the fore end of the mandrel, and a transfer mechanism for moving the grinder mechanism toward and away from the mandrel.

According to another feature of the present invention, the mandrel cleaning device includes in combination, a rotary mechanism for rotating the mandrel about its axis, a grinder mechanism adapted to grind a tip portion at the fore end of the mandrel, a scalping ring axially slidably fitted on the mandrel, a back-up mechanism adapted to back up the scalping ring, and a transfer mechanism for moving the grinder and back-up mechanism toward and away from the mandrel.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
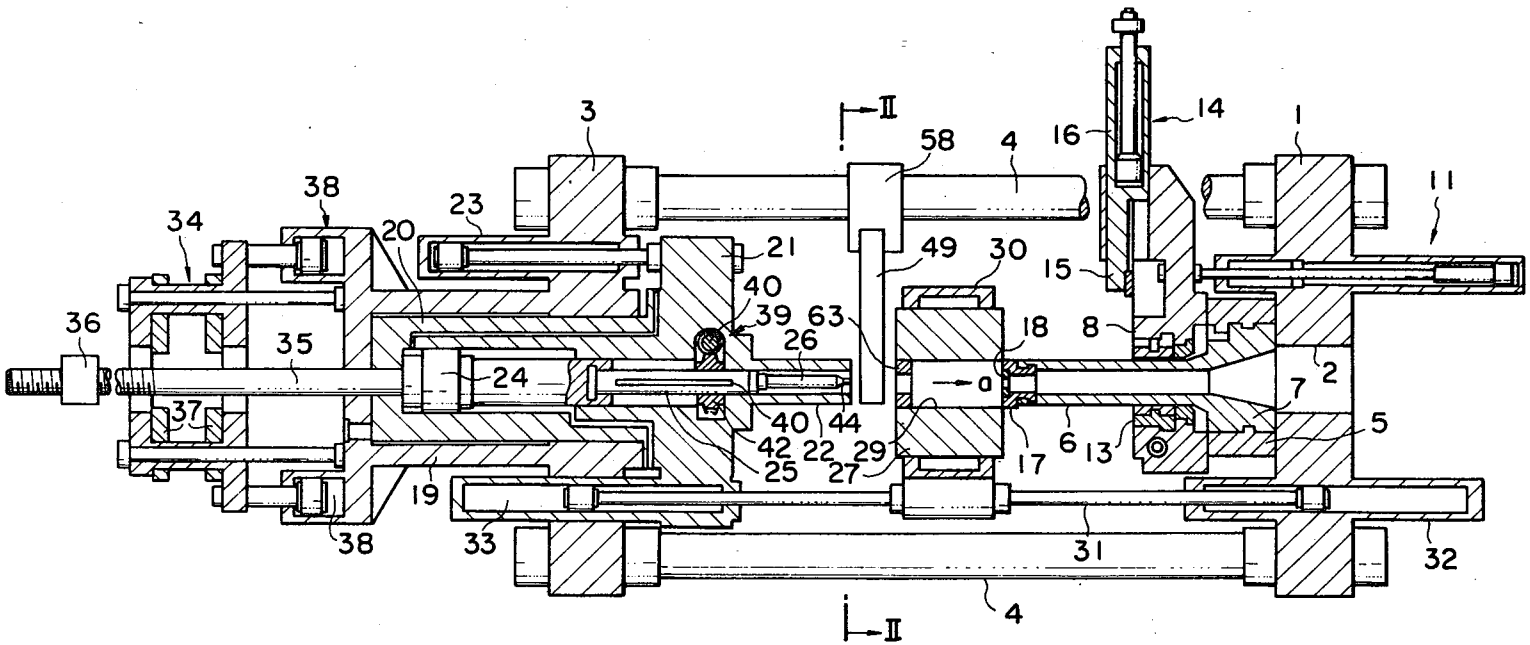
FIG. 1 is a diagrammatic sectional view of an extrusion press incorporating the present invention.
Figure 2:
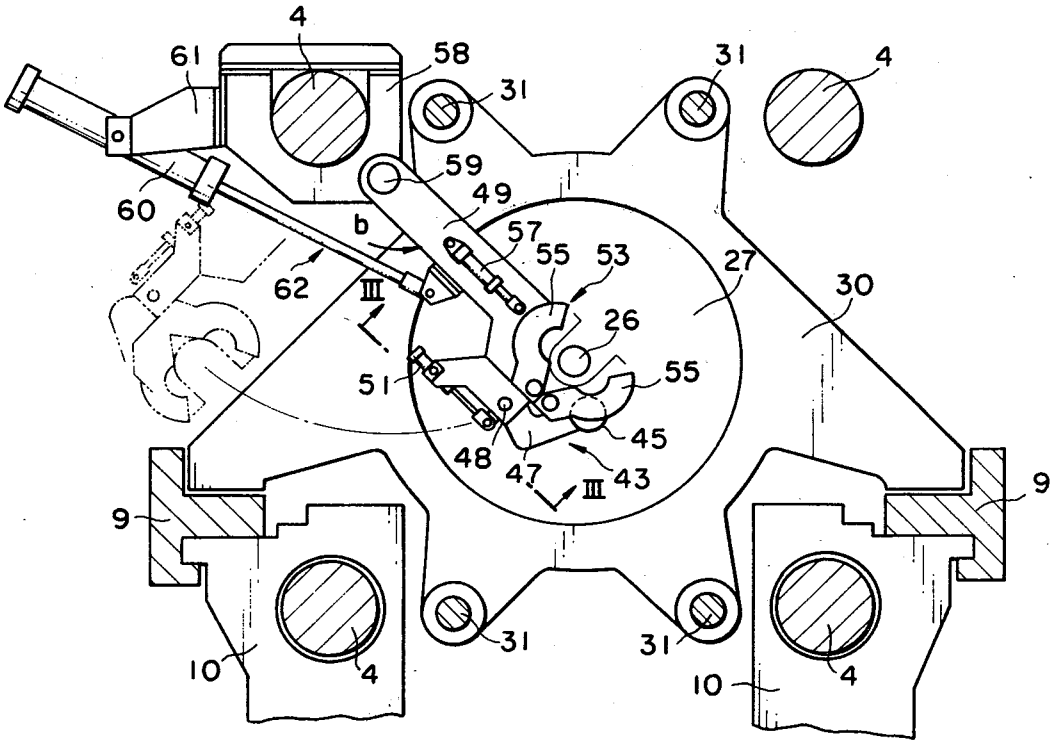
FIG. 2 is an enlarged view taken in the direction of arrows II—II of FIG. 1.

Referring to FIGS. 1 and 2, there is shown an extrusion press incorporating a cleaning device according to the present invention, in which indicated by reference number 1 is a press platen with a bore 2 at the press center and by 3 a main cylinder frame which is connected to press platen 1 by a plurality of columns 4 and mounted on a press bed along with press platen 1. Designated by reference number 5 is a die stem guide which is mounted on press platen 1, and by 6 a lengthy cylindrical die stem which is supported by die stem guide 5 through a die stem slide 7 and is fixably slidable between a position at the press center and a position outside the press.

An intermediate frame 8 which is moved back and forth along a press bed 10 by a piston-cylinder 11 has a guide ring 12 slidably fitted on die stem 6 at the press center through a guide slide 13 and supports thereon a shear mechanism 14. Shear mechanism 14 includes a shear member 15 and a shear cylinder 16 which drives shear member 15 perpendicularly to the pressing direction. A die 18 is mounted in position on die stem 6 through a die ring 17 attached to the fore end of die stem 6. A main ram 20 is slidably fitted in a main cylinder 19 which is mounted on the main cylinder frame 3. A crosshead 21 and a pressurizing stem 22 are provided at the fore end of main ram 20, crosshead 21 being driveable by a side cylinder 23 which is mounted on main cylinder frame 3. A mandrel piston 24 is slidably fitted in main ram 20 and has a mandrel 26 connected thereto through a mandrel holder 25. Mandrel 26 is slidable axially relative to pressurizing stem 22.

Indicated by reference number 27 is a container which is provided with a receptacle bore 29 at the press center for receiving a billet 28 and moved through a container holder 30 in the pressing direction by operation of a container transfer mechanism including a container cylinder 32 and a piston 31 which are mounted on press platen 2. Container holder 30 is connected to a piston of a fluid coupling cylinder 33 which is mounted on crosshead 21. A mandrel locking mechanism 34 with a stopper 37 which is engageable with a tail block 36 of a tail rod 35 is mounted on main cylinder 19 through a mandrel cushion cylinder 38.

A rotary drive mechanism 39 which rotates mandrel 26 about its axis includes a worm 40 which is rotatably supported on the crosshead 21 and a worm wheel 42 which is meshed with worm 40 and keyed to mandrel holder 25 axially slidably relative to the latter, worm 40 being driven from an electric, hydraulic or pneumatic motor (not shown).

Figure 4:
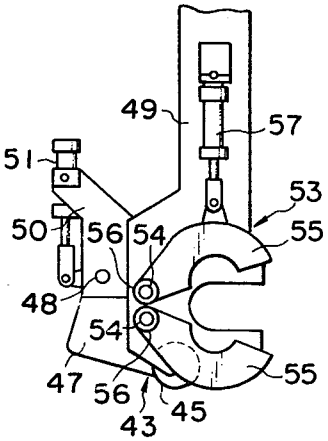
FIG. 4 is a view taken in the direction of arrows IV—IV of FIG. 3.
Figure 3:
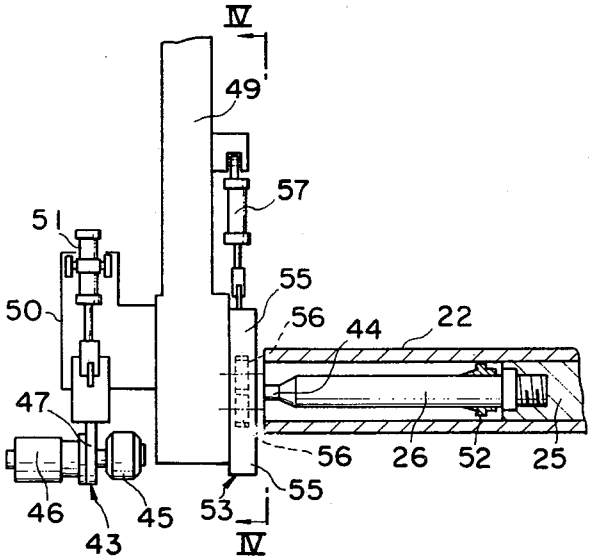
FIG. 3 is a view taken in the direction of arrows III—III of FIG. 2.

As shown in FIGS. 3 and 4, a grinder mechanism 43 which serves to grind a tip member 44 at the fore end of mandrel 26 includes a grinder 45 and an electric, hydraulic or pneumatic motor 46 which drives grinder 45. Grinder mechanism 43 is supported on a bracket 50 of an oscillatory or swing arm 49 through a grinder arm 47 and a support shaft 48 and rockable by operation of a grinder cylinder 51. A scalping ring 52 is axially slidably fitted on the shaft portion of mandrel 26 and is receivable within pressurizing stem 22. A back-up mechanism 53 which serves to back up scalping ring 52 has a pair of back-up plates 55 which are pivotally supported on swing arm 49 by support shafts 54. Support shafts 54 have gears 56 fixedly mounted thereon in meshing engagement with each other, and one back-up plate 55 is connected to back-up cylinder 57. Therefore, back-up plates 55 are opened and closed as desired by extension or contraction of back-up cylinder 57. Swing arm 49 is pivotally supported on a support frame 58 by a pivot shaft 59. By rocking movements of swing arm 49, grinder and back-up mechanisms 43 and 53 are swung into and out of the press center in a plane perpendicular to the pressing direction. Indicated by reference number 60 is a cylinder for rocking swing arm 49, which is mounted on support frame 58 through a bracket 61, by 62 a piston of the rocking cylinder 60 and by 63 a dummy block.

Figure 5:
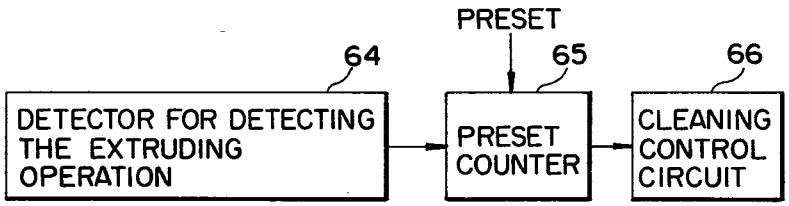
FIG. 5 is a block diagram of a control system.

FIG. 5 shows a cleaning control system in a block diagram, in which denoted by reference number 64 is a detector for detecting the extruding operation from, for example, the movement of main cylinder 4, and by 65 a preset counter which counts the number of pushes until a preset number is reached. The control system further includes a cleaning control circuit 66 which controls the operations of rocking cylinder 60, grinder cylinder 51 and back-up cylinder 57 with predetermined timing.

Now, the operation of the extrusion press of the above-described construction is explained by way of indirect extrusion of a hollow product A. In the initial phase of operation, a billet 28 of aluminum or the like and the dummy block 63 are loaded in the receptacle bore 29 of container 27, and then pressurizing stem 22 is moved in the direction of arrow a to fill receptacle bore 29 with billet 28. Thereafter, the operating fluid is applied to mandrel piston 24 to move mandrel 26 in the direction of arrow a, piercing through billet 28. Mandrel 26 is now locked in position by mandrel locking mechanism 34, with tip portion 44 of the mandrel held in a position confronting the opening of die 18.

Figure 6:
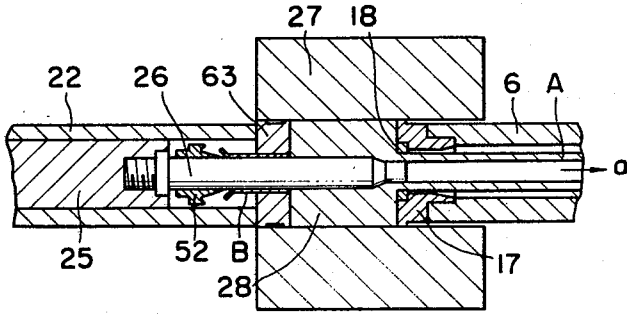
FIG. 6 is a diagrammatic sectional view of metal extruding operation.

In the next position, the crosshead 21 and container 27 are coupled with each other by fluid coupling cylinder 33 and the operating fluid is applied to main ram 20 and container cylinder 32 to move the pressurizing stem 22 and container 27 integrally in the direction of arrow a, whereupon, billet 28 is pressed against die 18 by pressurizing stem 22 to extrude a hollow metal product A of a thickness corresponding to the gap space between die 18 and mandrel 26 as shown particularly in FIG. 6, extruded product A being continuously delivered through die stem 6 and bore 2. Upon completion of the extrusion, crosshead 3 and container 27 are moved back in a direction reverse to the arrow a, and intermediate frame 8 is moved to an inner position at the inner free end of die stem 6 to cut off the discard which protrudes out of die 18, thus completing one cycle of extruding operation.

Figure 7:
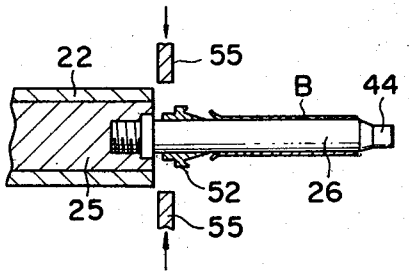
FIG. 7 is a diagrammatic sectional view of clamping operation.
Figure 8:
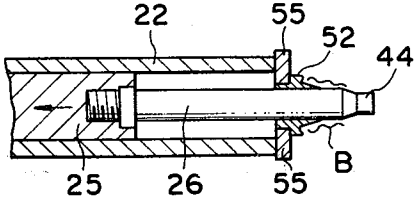
FIG. 8 is a diagrammatic sectional view of scalping operation.

Each cycle of the above-described extruding operation is detected by detector 64 and sequentially counted by preset counter 65. As soon as the preset number is reached, preset counter 65 produces an output signal by which cleaning control circuit 66 is actuated to start the operation for cleaning mandrel 26. More particularly, swing arm 49 is in an outer retracted position during the extruding operation as indicated in phantom lines in FIG. 2 is swung about pivotal shaft 59 in the direction of arrow b by extensional operation of rocking cylinder 60, transferring grinder and back-up mechanisms 43 and 53 to the press center. In the next position, back-up cylinder 57 is extended outwardly, rocking back-up plates 55 about respective support shafts 54 to clamp scalping ring 52 on mandrel 26 as shown in FIG. 7, and then the operating fluid is applied to piercing piston 24 to move mandrel 26 in a direction opposite that of arrow a, whereupon, since scalping ring 52 is restricted by pressurizing stem 22 through back-up plates 55, shells B on the shaft portion of mandrel 26 are scraped off by scalping ring 52 as a result of the relative movement of mandrel 26 as illustrated in FIG. 8. Thereafter, back-up cylinder 57 is contracted to release back-up plates 55.

Figure 9:
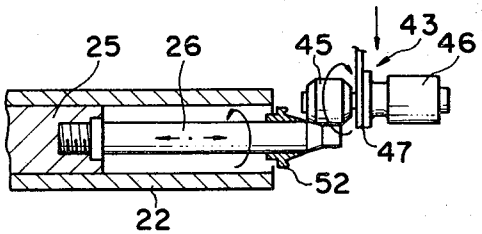
FIG. 9 is a diagrammatic sectional view of cleaning operation.

In the next phase, mandrel 26 is rotated about its axis by rotary drive mechanism 39 and at the same time grinder 43 which is being rotated about its axis by drive mechanism 46 is pressed against tip portion 44 at fore end of mandrel 26 as illustrated in FIG. 9 by swinging grinder arm 47 through extensional operation of grinder cylinder 51. As a result, tip portion 44 of mandrel 26 is polished by grinder 44. In this instance, it is extremely important to press grinder 43 against mandrel 26 to cope with variations in the diameter of mandrel 26 or abrasive wear of grinder 45. Upon completion of cleaning operation, rocking cylinder 60 is contracted to move back grinder and back-up mechanisms 43 and 53 into the respective outer receded positions indicated in phantom lines in FIG. 2.

Although scalping and grinding are effected in combination in the particular embodiment shown, it is not necessarily required to be so. If desired, scalping and grinding may be carried out alternately every several cycles or so of the cleaning operation or by being separately supported on separate structures. Further, it is to be understood that the cleaning device of the invention is applicable to not only the indirect extrusion type but also the direct extrusion type presses.

It is also possible to actuate the scalping and/or the grinder mechanism when the repeated number of ordinary cycles of the extrusion press reaches a predetermined number, resetting the counter to zero after completion of the cleaning operation to recommence the cycles of the extending operation, effecting the cleaning operations at an interval of a desired number of extruding cycles depending upon the choice of an operator.

As is clear from the foregoing particular description of a preferred embodiment, the cleaning device of the present invention is adapted to polish the tip portion at the fore end of the mandrel, which is rotated about its axis of the rotary drive mechanism by a grinder mechanism which is movable toward and away from the mandrel by means of a transfer mechanism. Therefore, as compared with conventional mandrel cleaning operations, the present invention contributes to lessening the burden on the part of the operator, reduction of the irregularities in the performance quality of the cleaning operation, enhancing of the safety of the operation and improving the quality of the extruded products. Further, since the scalping ring which is fitted on the mandrel is clamped by the back-up mechanism, it is possible to strip off the shells with the scalping ring simply by moving the mandrel, thereby further contributing to the enhancement of the product quality.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A mandrel cleaning device for an extrusion press including a pressurizing stem for pressing a billet in a container toward a die and a mandrel axially slidable in and relative to said pressurizing stem for determining the internal shape of a hollow extruding material, comprising:

rotary drive means for rotating said mandrel about the axis thereof;

grinder means for grinding an exterior tip portion at the fore end of said mandrel simultaneously with rotation of said mandrel by said rotary driven means; and transfer means for selectively moving said grinder means toward and away from said mandrel.

2. A mandrel cleaning device for an extrusion press including a pressurizing stem for pressing billet in a container toward a die and a mandrel axially slidable in and relative to said pressurizing stem for determining the internal shape of a hollow extruding material, comprising:

rotary drive means for rotating said mandrel about the axis thereof;

grinder means for grinding an exterior tip portion at the fore end of said mandrel simultaneously with rotation of said mandrel by said rotary drive means;

a scalping ring axially slidably fitted on said mandrel;

a back-up mechanism for backing up said scalping ring; and transfer means for selectively moving said grinder means and said back-up mechanism toward and away from said mandrel.

3. A mandrel cleaning device as set forth in claim 2, further comprising an electric control circuit including a preset counter for actuating said rotary drive means, said grinder means, said back-up mechanism and said transfer means at predetermined time intervals of a predetermined number of cycles of operation of said extrusion press.

* * * * *

UNITED STATES PATENT AND TRADEMARK OFFICE

CERTIFICATE OF CORRECTION

PATENT NO. : 4,399,676

DATED : AUGUST 23, 1983

INVENTOR(S) : NOYORI, TATSUHIKO; UEDA, MASAKAZU; KOBE; AOKI, MASANOBU; and KABUSHIKI KAISHA KOBE SEIKO SHO It is certified that error appears in the above-identified patent and that said Letters Patent is hereby corrected as shown below:

In column 1, line 51, after "for" delete "a";

In column 1, line 68, delete "nism" and insert therefor --nisms--;

In column 4, line 16, after "49" insert --which--;

In column 4, line 63, delete "extending" and insert therefor --extruding--;

In column 5, line 2, delete "of" and insert therefor --by--;

Signed and Sealed this

First Day of May 1984

[SEAL]

*Attest:*

GERALD J. MOSSINGHOFF

*Attesting Officer*

*Commissioner of Patents and Trademarks*